US005995050A

United States Patent [19]

Moller et al.

[11] Patent Number: 5,995,050

[45] Date of Patent: Nov. 30, 1999

[54] ANTENNA ARRANGEMENT FOR A WIRELESS COMMUNICATION DEVICE

[75] Inventors: Paul John Moller, Lake Zurich; Mike Albert, Chicago; Eric Arvid Anderson, Grayslake; James Phillips, Lake in the Hills; Jin Kim, Chicago, all of Ill.

[73] Assignee: Motorola, Inc., Schaumburg, Ill.

[21] Appl. No.: 08/734,573

[22] Filed: Oct. 17, 1996

Related U.S. Application Data

[63] Continuation of application No. 08/453,312, May 30, 1995, abandoned, which is a continuation of application No. 08/123,832, Sep. 20, 1993, abandoned.

[51] Int. Cl.[6] ..... H01Q 1/24

[52] U.S. Cl. ..... 343/702; 343/749; 343/895

[58] Field of Search ..... 343/702, 749, 343/750, 752, 895, 901

[56] References Cited

U.S. PATENT DOCUMENTS

| | | | |
|---|---|---|---|
| 4,121,218 | 10/1978 | Irwin et al. | 343/702 |
| 4,193,076 | 3/1980 | Ito et al. | 343/702 |
| 4,543,581 | 9/1985 | Nemet | 343/702 |
| 4,571,595 | 2/1986 | Phillips et al. | 343/702 X |
| 4,700,194 | 10/1987 | Ogawa et al. | 343/700 MS |
| 4,723,305 | 2/1988 | Phillips et al. | 343/702 X |
| 4,725,845 | 2/1988 | Phillips | 343/702 |
| 4,740,794 | 4/1988 | Phillips et al. | 343/702 |
| 4,868,576 | 9/1989 | Johnson, Jr. | 343/702 |
| 4,885,747 | 12/1989 | Foglia | 370/123 |
| 4,958,382 | 9/1990 | Imanishi et al. | 343/702 X |
| 5,177,492 | 1/1993 | Tomura et al. | 343/702 |
| 5,204,687 | 4/1993 | Elliot et al. | 343/702 |
| 5,343,213 | 8/1994 | Kohke et al. | 343/702 |
| 5,353,036 | 10/1994 | Baldry | 343/702 |
| 5,357,262 | 10/1994 | Blaese | 343/702 X |
| 5,374,937 | 12/1994 | Tsunekawa et al. | 343/702 |
| 5,412,392 | 5/1995 | Tsunekawa | 343/702 |
| 5,426,440 | 6/1995 | Shimada et al. | 343/702 X |
| 5,434,582 | 7/1995 | Koike et al. | 343/702 |
| 5,438,339 | 8/1995 | Itoh et al. | 343/702 |
| 5,467,096 | 11/1995 | Takamoro et al. | 343/895 X |
| 5,469,177 | 11/1995 | Rush et al. | 343/895 X |

FOREIGN PATENT DOCUMENTS

| | | | |
|---|---|---|---|
| 0 070 150 | 1/1983 | European Pat. Off. | H01Q 1/27 |
| 0508836 | 10/1992 | European Pat. Off. | H01Q 1/24 |
| 516490 | 12/1992 | European Pat. Off. | H01Q 1/24 |
| 522806 | 1/1993 | European Pat. Off. | H01Q 1/24 |
| 523867 | 1/1993 | European Pat. Off. | H01Q 1/24 |
| 5095218 | 4/1993 | Japan | H01Q 1/24 |

*Primary Examiner*—Don Wong
*Assistant Examiner*—Tan Ho
*Attorney, Agent, or Firm*—Kevin D. Kaschke

[57] ABSTRACT

An antenna arrangement (402) for a wireless communication device (400) comprises a first element (404) and a second element (406). The first element (404) is coupled to circuitry (408) of the wireless communication device (400). The second element (406) is movable between a first and a second position relative to the first element (404). The performance of the antenna arrangement (402) is substantially less desirable when the second element (406) is between the first and the second position than the performance of the antenna arrangement (402) when the second element (406) is at either the first or the second position. The second element (406) is mechanically spaced apart from and substantially electrically coupled to the first element (404) in both the first and the second position. The antenna arrangement (402) advantageously provides for reduced dimensions while achieving desirable performance.

32 Claims, 2 Drawing Sheets

-PRIOR ART-

-PRIOR ART-

-PRIOR ART-

ANTENNA ARRANGEMENT FOR A WIRELESS COMMUNICATION DEVICE

This is a continuation of application Ser. No. 08/453,312, filed May 30, 1995 and now abandoned, which is a continuation of Ser. No. 08/123,832, filed Sep. 20, 1993, now abandoned.

FIELD OF THE INVENTION

The present invention relates generally to a wireless communication device and more particularly to a wireless communication device including an antenna arrangement having a first element mechanically spaced apart from and substantially electrically coupled to a second element in both a first and a second position.

BACKGROUND OF THE INVENTION

Wireless communication devices in many forms are becoming increasingly popular. The term "wireless communication device" in this context encompasses cellular telephones, patio telephones, cordless telephones in their many different forms, personal communication devices, and the like.

Wireless communication devices are characterized by being easily transportable by the user.

Typically, wireless communication devices include an antenna arrangement for providing the wireless communication. The antenna arrangement may provide, in cooperation with circuitry of the wireless communication device, transmit, receive or transceiving functions for the wireless communication device. Desirable antenna arrangements are small, reliable and manufactureable. Since the wireless communication device is indeed transportable, desirable antenna arrangements are also typically moveable between a stowed and an unstowed position, for example, a retracted and an extended position, respectively.

Designers of antenna arrangements strive to optimize the size, reliability and manufacturability of the antenna arrangement while achieving desirable performance for the antenna arrangement. Since technology is driving the size of wireless communication devices to be smaller, the antenna arrangement for those smaller devices must also be made smaller to preserve the antenna arrangement's stowable feature and desirable performance. FIGS. 1–3 illustrate first, second and third antenna arrangements for a wireless communication device which seek to optimize both size and performance of the antenna arrangement in accordance with the prior art.

FIG. 1 illustrates the first antenna arrangement 102 for a wireless communication device 100 in accordance with the prior art. A detailed description of the antenna arrangement 102 in FIG. 1 is given in U.S. Pat. No. 4,121,218. The antenna arrangement 102 of FIG. 1 generally includes a helical antenna 104 and an extendible half-wave antenna 106. The helical antenna is coupled to circuitry 108 of the wireless communication device 100. The extendible half-wave antenna 106 is adapted to be capacitively coupled to the helical antenna 104 when in the extended position and to be substantially decoupled therefrom when in a retracted position (shown in dotted lines). Advantages of the antenna arrangement 102 include contactless coupling between the helical antenna 104 and the extendible half-wave antenna 106 and the performance of the antenna arrangement as indicated by the height 112 where the current maximum of the extendible half-wave antenna 106 occurs when the extendible half-wave antenna 106 is extended. However, a disadvantage of the antenna arrangement 102 is that its overall physical height 110 is too long to meet present day needs of miniature wireless communication devices.

FIG. 2 illustrates a second antenna arrangement 202 for a communication device 200 in accordance with the prior art. A detailed description of the antenna arrangement 202 in FIG. 2 is given in U.S. Pat. No. 4,868,576. The antenna arrangement 202 includes a helical antenna 204 coupled to circuitry 208 and an extendible half-wave helical antenna 206. An advantage of the antenna arrangement 202 over the antenna arrangement 102 of FIG. 1 is that the height 210 is lower than the height 110 of the antenna arrangement 102. However, a disadvantage of the antenna arrangement 202 is that the height 212 where the current maximum of the extendible half-wave antenna 206 occurs when the extendible half-wave antenna 206 is extended, is lower than the height 112 where the current maximum occurs in FIG. 1. Therefore, the performance of the antenna arrangement 202 was sacrificed for a shorter antenna.

FIG. 3 illustrates the third antenna arrangement 302 for a wireless communication device 300 in accordance with the prior art. The antenna arrangement 302 generally includes a first straight portion 304 and a second helical portion 306 which is electrically isolated from the first straight portion 304. The straight portion and the helical portion 306 each have an electrical wavelength of ¼ wavelength. The straight portion 304 includes a terminal 310 for connection to a connector 312 when the antenna arrangement is extended. Likewise, the helical portion 306 includes a terminal 314 for connection to the connector 312 when the antenna arrangement is retracted. Circuitry 308 is coupled to the antenna arrangement 302 via a connector 312. An advantage of the antenna arrangement 302 is that its height 316 is reduced even further than that represented in FIGS. 1 or 2. However, a disadvantage of the antenna arrangement 302 is that the height where the current maximum occurs when the antenna arrangement 302 is extended is much lower (shown below the housing of the device) than the height of the current maximum as shown in FIGS. 1 or 2. A further disadvantage is that metallic contacts of the connector produces electrical noise which reduces reliability.

Therefore, there is a need for an antenna arrangement for a wireless communication device having further reduced dimensions while achieving desirable performance as well as maintaining acceptable reliability and manufacturability.

DETAILED DESCRIPTION OF A PREFERRED EMBODIMENT

Figure 4:
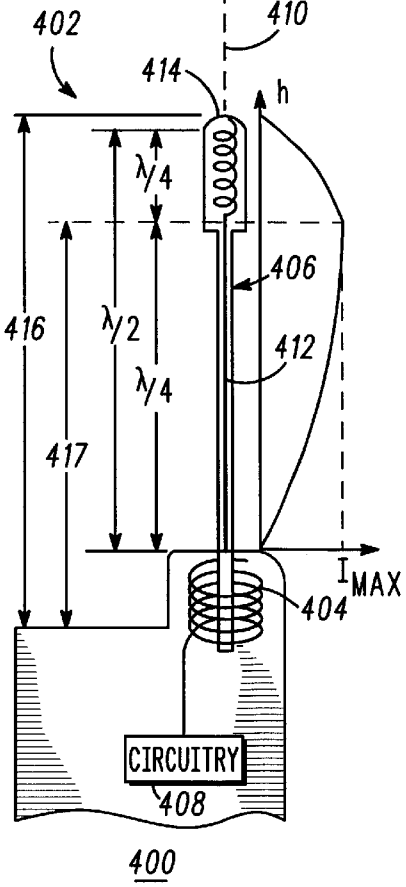
FIG. 4 illustrates an antenna arrangement for a wireless communication device, wherein a portion of the antenna arrangement is extended beyond the wireless communication device, in accordance with the present invention.

FIG. 4 illustrates an antenna arrangement 402 for a wireless communication device 400, wherein a moveable element 406 of the antenna arrangement 402 is extended beyond the wireless communication device 400, in accordance with the present invention. The wireless communication device 400 generally includes the antenna arrangement 402 and circuitry 408 coupled to the antenna arrangement 402. The antenna arrangement 402 generally includes a first element 404 and a second element 406.

The first element 404 is coupled to the circuitry 408 of the wireless communication device. The second element 406 is movable between a first position (shown in FIG. 4) and a second position (shown in FIG. 5) relative to the first element 404. The performance of the antenna arrangement 402 is substantially less desirable when the second element 406 is between the first and the second position than the performance of the antenna arrangement 402 when the second element 406 is at either the first or the second position. The second element 406 is mechanically spaced apart from and substantially electrically coupled to the first element 404 in both the first and the second positions.

Figure 1:
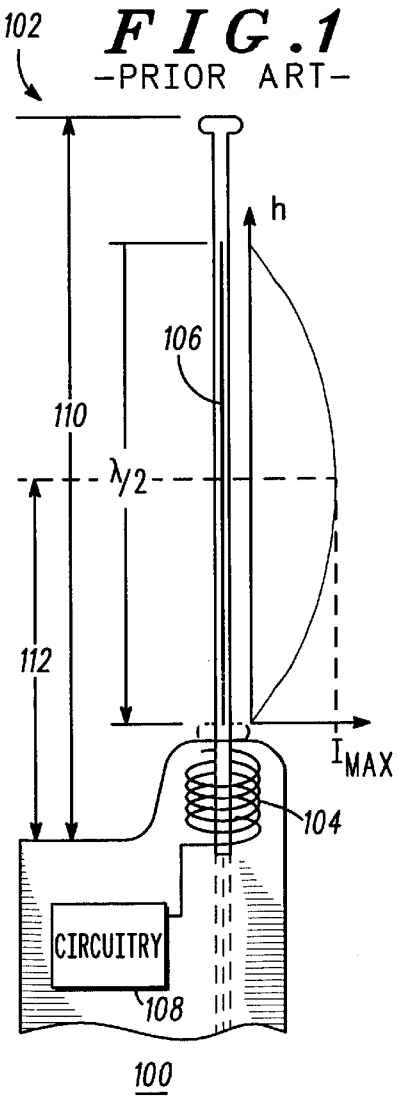
FIG. 1 illustrates a first antenna arrangement for a wireless communication device in accordance with the prior art.
Figure 2:
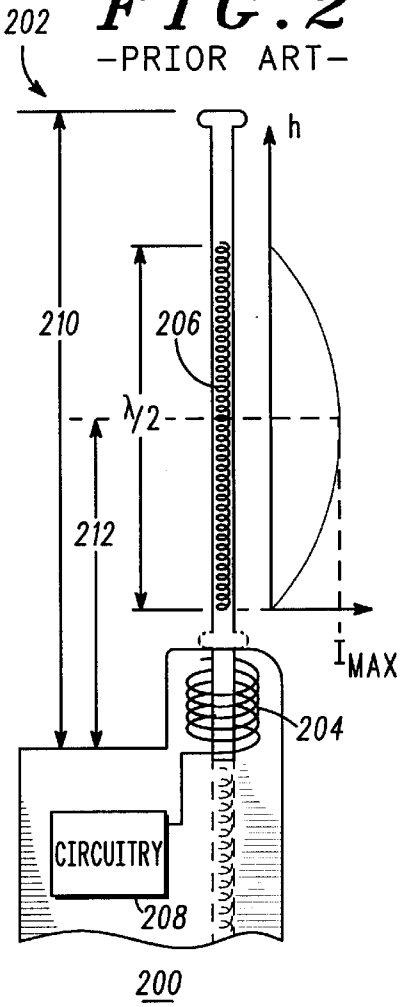
FIG. 2 illustrates a second antenna arrangement for a wireless communication device in accordance with the prior art.
Figure 3:
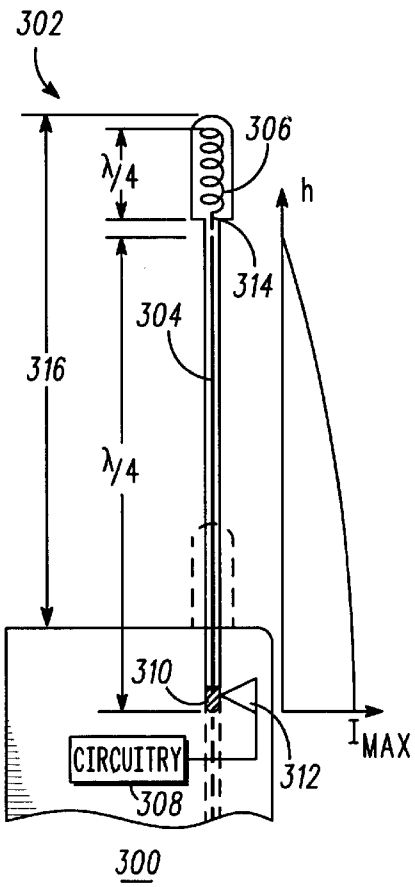
FIG. 3 illustrates a third antenna arrangement for a wireless communication device in accordance with the prior art.

Since the second element is mechanically spaced apart from and substantially electrically coupled to the first element in both the first and the second position, the antenna arrangement of the present invention optimizes both size and performance in such a way that was not achieved in the prior art as shown in FIGS. 1–3. A detailed description of such optimization is given below.

In accordance with a preferred embodiment of the present invention, the second element 406 is movable along a longitudinal axis 410 of the second element 406. Axial movement of the second element 406 is advantageous for easily stowing the second element 406 within the communication device 400. However, other antenna arrangements may be implemented to move in other axes such as rotational or lateral, while obtaining the same advantages of the present invention.

Figure 5:
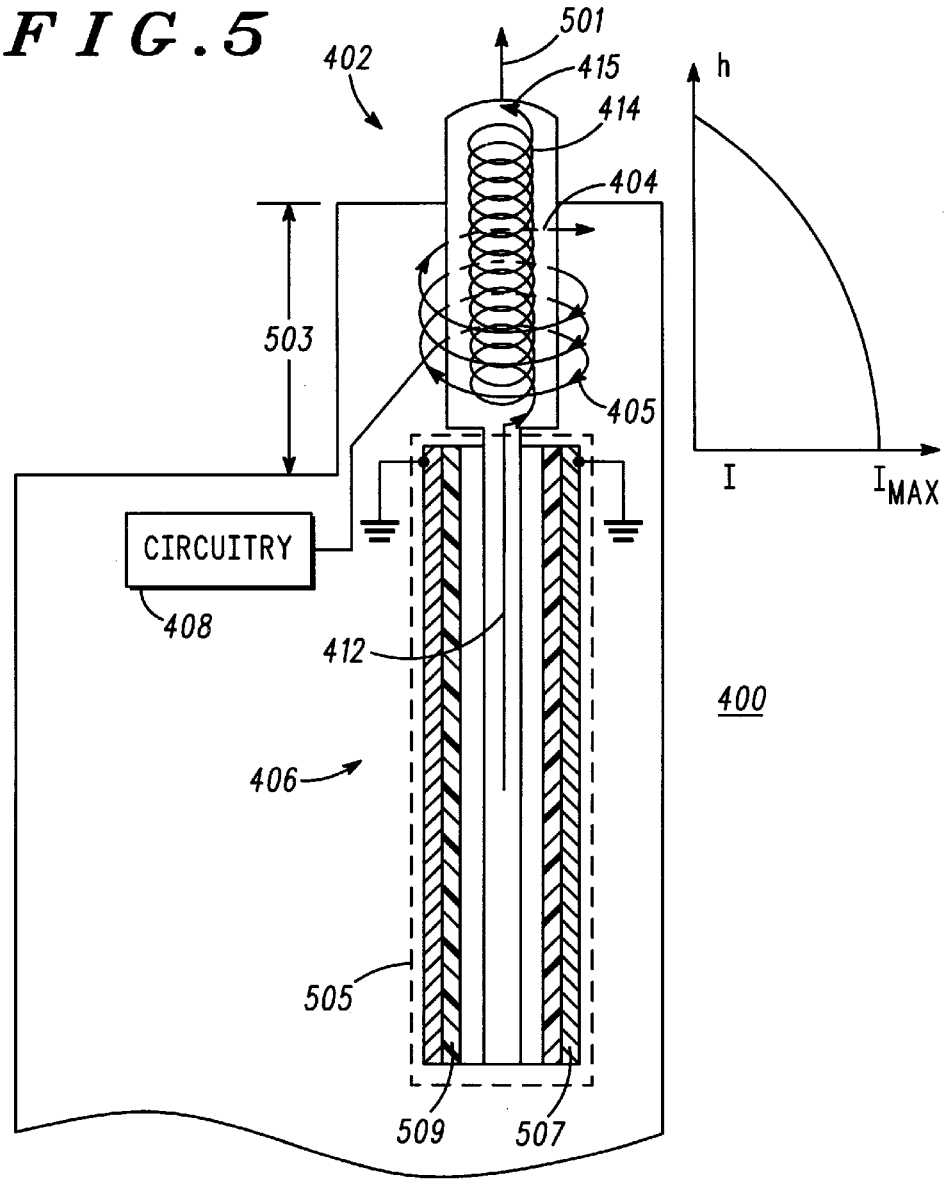
FIG. 5 illustrates an antenna arrangement for a wireless communication device, wherein a portion of the antenna arrangement is stowed within the communication device, in accordance with the present invention.

In the preferred embodiment of the present invention, the second element 406 is substantially extended beyond the wireless communication device 400 in the first position (see FIG. 4) and is substantially stowed within the wireless communication device 400 in the second position (see FIG. 5). Alternatively, the second element 406 may be stowed outside the wireless communication device 400. Further, the second element 406 may itself be a telescoping element and remain within the scope of the present invention.

In the preferred embodiment of the present invention, the second element 406 comprises a first portion 412 having a straight form and a second portion 414 having a helical form, wherein the first portion 412 is electrically coupled to the second portion 414. In the preferred embodiment, the coupling between the first portion 412 and the second portion 414 is a direct connection made by forming the first portion and the second portion 414 from a single piece of wire. However, the first portion 412 and the second portion 414 may alternatively be constructed of two separate wires and thereafter electrically and mechanically connected, such as with solder or a weld joint.

The antenna arrangement 402 of the present invention as shown in FIG. 4 is similar to the antenna arrangement 302 of the prior art as shown in FIG. 3 in that the moveable portion of the antenna arrangement 402 of the present invention includes both a straight form and a helical form. The difference between the present invention and the prior art is that in the present invention the first portion having a straight form 412 is electrically coupled to the second portion 414 having a helical form; whereas, in the prior art the portion 304 having a straight form is electrically isolated from the second portion 306 having a helical form. The advantages of electrically coupling the first portion 406 having the straight form and the second portion 414 having the helical form in the present invention will be described further below.

Alternatively, the first portion 412 having a straight form of the second element 406 may instead have a helical form with a helical diameter smaller than the helical diameter of the second portion 414 having a helical form. A first portion 412 having a helical form provides the advantage of even further reducing the height of the second element 406. However, mechanical reliability of the second element 406 is sacrificed because a helical coil has less memory against permanent mechanical deformation than a straight form.

In the preferred embodiment of the present invention, the first portion 412 having a straight form is coupled to the first element 404 when the second element 406 is moved to the first position (see FIG. 4) and the second portion 414 having a helical form is coupled to the first element 404 when the second element 406 is moved to the second position (see FIG. 5).

In the preferred embodiment of the present invention, the antenna arrangement 402 operates over a frequency band. The first portion 412 and the second portion 414 together comprise an effective electrical length defined by an integer multiple of one half wavelength at at least one frequency in the frequency band. As shown in FIG. 4, the second element 406 has an electrical length of one half wavelength, wherein the first portion 412 having the straight form has an electrical length of one-quarter wavelength and the effective electrical length of the second portion 414 having a helical form is also one quarter wavelength.

In the preferred embodiment, the height 417 where the maximum current occurs is at the junction of the first portion 412 and the second portion 414. Forming the second element 406 in this way provides a reduced antenna height 416 while providing a maximum current height 417 near the top of the second element 406. The present invention advantageously provides the height 417 where the maximum current occurs in the present invention at the same height 112 as shown in FIG. 1 of the prior art, while substantially reducing the height 416 of the extendible element 406 in the present invention as compared to the height 110 of the extendible element 106 in the prior art. When comparing the present invention as shown in FIG. 4 to the prior art in FIGS. 2 and 3, the structure of the second element 406 of the present invention provides the same or less height 416 while achieving a greater height 417 at the point where the current maximum occurs.

In the preferred embodiment of the present invention, the first element 404 has a helical element. The first element 404 generally represents an impedance transformer for transforming the impedance of the circuitry 408 to the driving point impedance of the second element 406 to produce an impedance match. The first element 404 provides connectorless intercoupling similar to that shown in FIGS. 1 and 2 of the prior art but different from the connector arrangement shown in FIG. 3. A contactless, connectorless arrangement of the present invention is an improvement over the connector system of the prior art as shown in FIG. 3 in that the problems of contaminated and wearable contacts are eliminated.

In the preferred embodiment of the present invention, the first element 404 comprises an electrical length defined by an odd integer multiple of one quarter wavelength at at least one frequency substantially near the frequency band. In particular, the electrical length is one quarter wavelength.

FIG. 5 illustrates an antenna arrangement 402 for a wireless communication device 400, wherein a portion 406 of the antenna arrangement 402 is stowed within the wireless communication device 400, in accordance with the present invention.

In the preferred embodiment of the present invention, the first element 404 is wound in a first direction (as indicated by arrows 405 on the helix) relative to a forming direction 501 and the helical form of the second portion 414 of the second element 406 is wound in a second direction (as indicated by arrows 415 on the helix), opposite to the first direction, relative to the forming direction 501. The helical forms are wound in opposite directions in order to reduce coupling between the first element 404 and the second portion 414 of the second element 406. Reduced coupling is necessary to achieve a desirable impedance match given the physical dimensions of the antenna arrangement 402 of the present invention. However, other antenna arrangements may utilize helical forms wound in the same direction given other dimensional requirements and fall within the scope of the present invention.

Coupling energy between the first element 404 and the first 412 or second 414 portion of the second element 406 in this manner is known as mutual coupling. Capacitive coupling is described in detail in U.S. Pat. No. 4,121,218, herein incorporated by reference. Mutual coupling includes both capacitive coupling and inductive coupling. When the helical forms are wound in the same direction the capacitive coupling is added to the inductive coupling to produce a total mutual coupling greater than either the capacitive coupling or the inductive coupling. When the helical forms are wound in opposite directions, the inductive coupling is subtracted from the capacitive coupling to produce the total mutual coupling that is less than the capacitive coupling and therefor less than the total mutual coupling when the helical forms are wound in the same direction.

Since the second portion 414 of the second element 406 is substantially electrically coupled to the first element 404 in the second position, both the second portion 414 and the first element 404 together form the radiating portion of the antenna arrangement 402 when the second element 406 is at the second position. An advantage of such a structure is that the height 503 of the first element 404 is reduced relative to the prior art shown in FIGS. 1 and 2 without sacrificing performance of the antenna arrangement 402 when the second element 406 is at the second position. Reduced height 503 of the first element 404 is important for the aesthetic appearance of small wireless communication devices.

To provide proper performance, the antenna provides an input impedance which is similar in both the first position and the second position. This is achieved through proper selection of the dimensions of the straight portion 412 and the helix portion 414.

In accordance with the preferred embodiment of the present invention, the first portion 412 forms a first component of a transmission line 505 and the second portion 404 forms a radiating element of the antenna arrangement 402 when the second element is at the second position. A second component of the transmission line 505 includes a conductive portion 507 and a dielectric portion 509. The dielectric portion 509 is disposed between the first component 412 of the transmission line 505 and the conductive portion 507. In the preferred embodiment, the transmission line 505 is formed as a coaxial transmission line; however, other transmission line structures such as strip line, microstrip and balanced transmission line structures may also be implemented in accordance with the present invention. In the preferred embodiment, the conductive portion 507 is a metal tube; however, the conductive portion 507 may also comprise a conductive surface inside the housing of the wireless communication device 400.

The transmission line 505 has an electrical length at least partially related to an electrical characteristic, for example permittivity, of the dielectric portion 509 as well as the electrical length of the conductive portion 507. These characteristics may be adjusted to achieve a desirable impedance match for the antenna arrangement 402 according to dimensional requirements.

In accordance with the preferred embodiment of the present invention, the transmission line 505 comprises a reactive termination. In the preferred embodiment, the reactive termination is an open circuit, however a short circuit or lumped element may also be implemented in accordance with the present invention. The impedance at the junction of the straight portion 412 and the helix portion 414 in relation to the conductive tube 507 is made to be low so that a current maximum occurs. Multiple configurations of reactive terminations and lengths of the straight section 412 and tube 507 will achieve this condition. The final configurations for 412, 507 and 509 are selected from the allowed parameters in both the first and the second position.

Figure 6:
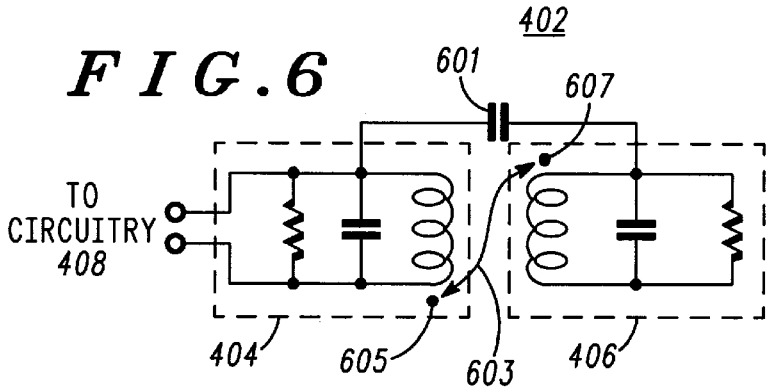
FIG. 6 illustrates a schematic diagram for the antenna arrangement of FIGS. 5 and 6 in accordance with the present invention.

FIG. 6 illustrates a schematic diagram for the antenna arrangement 402 of FIGS. 4 and 5 in accordance with the present invention. The schematic representation of the first element 404 and the schematic representation of the second element 406 each contain a representation of inductance, capacitance and resistance in those elements as is well known in the art. A capacitor 601 represents the capacitive coupling contribution to the total mutual coupling. The bi-directional arrow, represented by reference numeral 603 between each element, represents the inductive coupling contribution of the total mutual coupling of the antenna arrangement. Dots 605 and 607 together represent the phase of the magnetic coupling between the first element 404 and the second element 406. Capacitive coupling occurs between the unconnected ends of the helixes 404 and 414 in the first position and between the open end of the helix 404 and the open end of the straight portion 412 in the second position. It is maximized by the high voltages which exist on these locations during operation. Inductive coupling occurs between the connected ends of the helixes 404 and 414 in the second position. The inductive coupling is maximized by the high current existing at these locations during operation.

The present invention is primarily intended to be used for antenna arrangements operating in the range of 150–900 MHz, and in the preferred embodiment, 900 MHz. The following description provides a detailed description, by example, of the antenna arrangement 402 in accordance with the present invention. The preferred embodiment has a helix 404 with a diameter of 7.0 mm and a length of 9.0 mm with 4 turns. The helix 414 has a length of 33.3 mm and a diameter of 4.6 mm with 10.75 turns. The straight portion has a length of 64 mm. The dielectric in the tube is Teflon with a dielectric constant of 2.1.

What is claimed is:

1. An antenna arrangement adapted for use with a wireless communication device comprising:

a first element coupled to circuitry of the wireless communication device;

a second element moveable between a first position and a second position relative to the first element, wherein the second element is mutually electrically coupled to the first element without making direct contact with the first element when the second element is moved to the first position and when the second element is moved to the second position; and an output impedance matching device for providing a first output impedance for the second element when the second element is moved to the first position and for providing a second output impedance for the second element when the second element is moved to the second position so that an input impedance for the antenna arrangement is substantially the same when the second element is moved to the first position and to the second position.

2. An antenna arrangement in accordance with claim 1 wherein the first element has a helical form.

3. An antenna arrangement in accordance with claim 1 wherein the antenna arrangement operates over a frequency band, the first element comprises an electrical length defined by an odd integer multiple of one quarter wavelength at at least one frequency substantially near the frequency band.

4. An antenna arrangement in accordance with claim 1 wherein the antenna arrangement operates over a frequency band, the second element comprises an electrical length defined by an integer multiple of one half wavelength at at least one frequency in the frequency band.

5. An antenna arrangement in accordance with claim 1 wherein the second element is moveable along a longitudinal axis of the second element.

6. An antenna arrangement in accordance with claim 5 wherein second element is substantially extended beyond the wireless communication device in the first position and is substantially stowed within the wireless communication device in the second position.

7. An antenna arrangement in accordance with claim 1 wherein the second element comprises a first portion having a straight form and a second portion having a helical form, wherein the first portion is electrically coupled to the second portion.

8. An antenna arrangement in accordance with claim 7, wherein the antenna arrangement operates over a frequency band, the first and the second portions together comprise an electrical length defined by an integer multiple of one half wavelength at least one frequency in the frequency band.

9. An antenna arrangement in accordance with claim 7 wherein the first portion having a straight form is capacitively coupled to the first element when the second element is moved to the first position and the second portion having a helical form is inductively coupled to the first element when the second element is moved to the second position.

10. An antenna arrangement in accordance with claim 7, wherein the first element has a helical form, the helical form of the first element is wound in a first direction relative to a forming direction and the helical form of the second portion of the second element is wound in a second direction, opposite to the first direction, relative to the forming direction.

11. An antenna arrangement in accordance with claim 1 wherein the output impedance matching device further comprises:

an output impedance matching circuit, coupled to the first element, for providing a third output impedance for the second element when the second element is moved to the first position and the second position; and an output impedance matching structure, operatively coupled to the second element, for providing a fourth output impedance for the second element when the second element is moved to the first position and for providing a fifth output impedance, different from the fourth output impedance, for the second element when the second element is moved to the second position, wherein the third output impedance in combination with the fourth output impedance provides the first output impedance, and wherein the third output impedance in combination with the fifth output impedance provides the second output impedance.

12. An antenna arrangement in accordance with claim 11 wherein the impedance matching structure further comprises a transmission line structure.

13. An antenna arrangement in accordance with claim 12 wherein the transmission line structure further comprises:

a first conductor formed by a portion of the second element;

a second conductor; and a dielectric portion disposed between the first conductor and the second conductor.

14. An antenna arrangement in accordance with claim 12 wherein the transmission line comprises a reactive termination.

15. An antenna arrangement adapted for use with a wireless communication device operating over a frequency band, comprising:

a first element having a helical form and coupled to circuitry of the wireless communication device;

a second element including a first portion having a straight form electrically coupled to a second portion having a helical form, wherein the second element is moveable between a first position and a second position along a longitudinal axis of the second element and relative to the first element, wherein the first portion having a straight form is capacitively coupled to the first element when the second element is moved to the first position and the second portion having a helical form is inductively coupled to the first element when the second element is moved to the second position; and an output impedance matching device for providing a first output impedance for the second element when the second element is moved to the first position and for providing a second output impedance for the second element when the second element is moved to the second position so that an input impedance for the antenna arrangement is substantially the same when the second element is moved to the first position and to the second position.

16. An antenna arrangement in accordance with claim 15 wherein the first element comprises an electrical length defined by an odd integer multiple of one quarter wavelength at at least one frequency substantially near the frequency band.

17. An antenna arrangement in accordance with claim 15 wherein the second element comprises an electrical length defined by an integer multiple of one half wavelength at at least one frequency in the frequency band.

18. An antenna arrangement in accordance with claim 15 wherein second element is substantially extended beyond the wireless communication device in the first position and is substantially stowed within the wireless communication device in the second position.

19. An antenna arrangement in accordance with claim 15 wherein the helical form of the first element is wound in a first direction relative to a forming direction and the helical form of the second portion of the second element is wound in a second direction, opposite to the first direction, relative to the forming direction.

20. An antenna arrangement in accordance with claim 15 wherein the output impedance matching device further comprises:

an output impedance matching circuit, coupled to the first element, for providing a third output impedance for the second element when the second element is moved to the first position and the second position; and an output impedance matching structure, operatively coupled to the second element, for providing a fourth output impedance for the second element when the second element is moved to the first position and for providing a fifth output impedance, different from the fourth output impedance, for the second element when the second element is moved to the second position, wherein the third output impedance in combination with the fourth output impedance provides the first output impedance, and wherein the third output impedance in combination with the fifth output impedance provides the second output impedance.

21. An antenna arrangement in accordance with claim 20 wherein the impedance matching structure further comprises a transmission line structure.

22. An antenna arrangement in accordance with claim 21 wherein the transmission line structure further comprises:

a first conductor formed by the first portion of the second element;

a second conductor; and a dielectric portion disposed between the first conductor and the second conductor.

23. An antenna arrangement in accordance with claim 21 wherein the transmission line comprises a reactive termination.

24. A wireless communication device comprising:

circuitry for operating the wireless communication device; and an antenna arrangement including:

a first element coupled to the circuitry;

a second element moveable between a first and a second position relative to the first element, wherein the second element is mutually electrically coupled to the first element without making direct contact with the first element when the second element is moved to the first position and when the second element is moved to the second position; and an output impedance matching device for providing a first output impedance for the second element when the second element is moved to the first position and for providing a second output impedance for the second element when the second element is moved to the second position so that an input impedance for the antenna arrangement is substantially the same when the second element is moved to the first position and to the second position.

25. A wireless communication device in accordance with claim 24 wherein the second element is capacitively coupled to the first element when the second element is moved to the first position and inductively coupled to the first element when the second element is moved to the second position.

26. A wireless communication device in accordance with claim 24 wherein the second element is capacitively coupled to the first element when the second element is moved to the first position and inductively coupled to the first element when the second element is moved to the second position.

27. An antenna arrangement adapted for use with a portable radiotelephone comprising:

a first element coupled to a transceiver of the portable radiotelephone;

a second element moveable between a first position and a second position relative to the first element, wherein the second element is mutually electrically coupled to the first element without making direct contact with the first element when the second element is moved to the first position and when the second element is moved to the second position; and an output impedance matching device for providing a first output impedance for the second element when the second element is moved to the first position and for providing a second output impedance for the second element when the second element is moved to the second position so that an input impedance for the antenna arrangement is substantially the same when the second element is moved to the first position and to the second position.

28. A portable radiotelephone in accordance with claim 27 wherein the second element is capacitively coupled to the first element when the second element is moved to the first position and inductively coupled to the first element when the second element is moved to the second position.

29. An antenna arrangement adapted for use with a portable radiotelephone comprising:

a first element having a helical form and coupled to a transceiver of the portable radiotelephone;

a second element including a first portion having a straight form electrically coupled to a second portion having a helical form, wherein the second element is axially moveable between an extended position and a retracted position relative to the first element, wherein the first portion having a straight form is capacitively coupled to the first element when the second element is moved to the first position and the second portion having a helical form is inductively coupled to the first element when the second element is moved to the second position; and an output impedance matching device for providing a first output impedance for the second element when the second element is moved to the first position and for providing a second output impedance for the second element when the second element is moved to the second position so that an input impedance for the antenna arrangement is substantially the same when the second element is moved to the first position and to the second position.

30. A portable radiotelephone comprising:

a housing;

a transceiver disposed within the housing; and an antenna arrangement comprising:

a first element coupled to the transceiver and disposed at a top portion of the housing;

a second element moveable between a first position and a second position relative to the first element, wherein the second element is mutually electrically coupled to the first element without making direct contact with the first element when the second element is moved to the first position and when the second element is moved to the second position; and an output impedance matching device for providing a first output impedance for the second element when the second element is moved to the first position and for providing a second output impedance for the second element when the second element is moved to the second position so that an input impedance for the antenna arrangement is substantially the same when the second element is moved to the first position and to the second position.

31. A portable radiotelephone in accordance with claim 30 wherein the second element is capacitively coupled to the first element when the second element is moved to the first position and inductively coupled to the first element when the second element is moved to the second position.

32. A portable radiotelephone comprising:

a housing;

a transceiver disposed within the housing; and an antenna arrangement comprising:

a first element having a helical form coupled to a transceiver and disposed at a top portion of the housing;

a second element including a first portion having a straight form electrically coupled to a second portion having a helical form, wherein the second element is axially moveable between an extended position and a retracted position relative to the first element, wherein the first portion having a straight form is capacitively coupled to the first element when the second element is moved to the first position and the second portion having a helical form is inductively coupled to the first element when the second element is moved to the second position; and an output impedance matching device for providing a first output impedance for the second element when the second element is moved to the first position and for providing a second output impedance for the second element when the second element is moved to the second position so that an input impedance for the antenna arrangement is substantially the same when the second element is moved to the first position and to the second position.

* * * * *